US005604473A

United States Patent [19]

Rodenbush

[11] Patent Number: 5,604,473

[45] Date of Patent: Feb. 18, 1997

[54] SHAPED SUPERCONDUCTING MAGNETIC COIL

[75] Inventor: Anthony J. Rodenbush, Marlborough, Mass.

[73] Assignee: American Superconductor Corporation, Westborough, Mass.

[21] Appl. No.: 323,494

[22] Filed: Oct. 13, 1994

[51] Int. Cl.[6] ..... H01F 1/00; H01F 6/00; H01F 7/00

[52] U.S. Cl. ..... 335/216; 505/705; 505/879

[58] Field of Search ..... 335/216, 296, 335/299, 301; 336/DIG. 1; 324/318–320; 505/211, 230–232, 705, 844, 879, 880

[56] References Cited

U.S. PATENT DOCUMENTS

| | | | |
|---|---|---|---|
| 2,344,334 | 3/1944 | Vienneau | 175/362 |
| 3,071,845 | 1/1963 | Leonard et al. | 29/155.57 |
| 3,258,828 | 7/1966 | Swartz | 29/155.5 |
| 3,333,331 | 8/1967 | Swartz | 29/599 |
| 3,463,376 | 8/1969 | Whiteman | 226/148 |
| 3,464,109 | 9/1969 | Parker | 29/605 |
| 3,473,217 | 10/1969 | Prior | 29/599 |
| 3,474,370 | 10/1969 | Lightner | 336/192 |
| 3,495,202 | 2/1970 | Parker | 336/186 |
| 3,528,172 | 9/1970 | Smulkowski | 29/602 |
| 3,636,990 | 1/1972 | Eminger et al. | 140/92.1 |
| 3,733,692 | 5/1973 | Fletz et al. | 29/599 |
| 3,813,764 | 6/1974 | Tanaka et al. | 29/599 |
| 4,135,294 | 1/1979 | Brown | 29/605 |
| 4,499,443 | 2/1985 | Materna | 335/216 |
| 4,561,175 | 12/1985 | Kawasumi | 29/605 |
| 4,623,864 | 11/1986 | Inoue et al. | 335/299 |
| 4,814,731 | 3/1989 | Sato et al. | 335/216 |
| 5,132,278 | 7/1992 | Stevens et al. | 505/1 |
| 5,200,391 | 4/1993 | Fisher et al. | 505/1 |

FOREIGN PATENT DOCUMENTS

| | | |
|---|---|---|
| 850264 | 8/1970 | Canada . |
| 0180359 | 5/1986 | European Pat. Off. . |
| 0472197A1 | 2/1992 | European Pat. Off. . |
| 60-182119 | 9/1985 | Japan . |
| 4-42907 | 2/1992 | Japan . |
| 5-55060 | 3/1993 | Japan . |
| 1348888 | 3/1974 | United Kingdom . |

*Primary Examiner*—Brian W. Brown
*Assistant Examiner*—Raymond M. Barrera
*Attorney, Agent, or Firm*—Fish & Richardson P.C.

[57] ABSTRACT

Double pancake coils include a pair of pancake coils of different outer dimensions, and are wound from the same continuous length of superconducting wire. The double pancake coils are coaxially positioned and electrically interconnected along a longitudinal axis to provide a multi-coil superconducting magnetic coil assembly. Each of the double pancakes has at least one of its pancake coils electrically connected to at least another pancake coil of an adjacent double pancake coil having substantially the same outer dimension. The electrical connections between adjacent pancake coils are provided with relatively straight or "unbent" segments of superconducting wire even though the outer dimension profile of the superconducting magnetic coil assembly along its longitudinal axis varies.

15 Claims, 3 Drawing Sheets

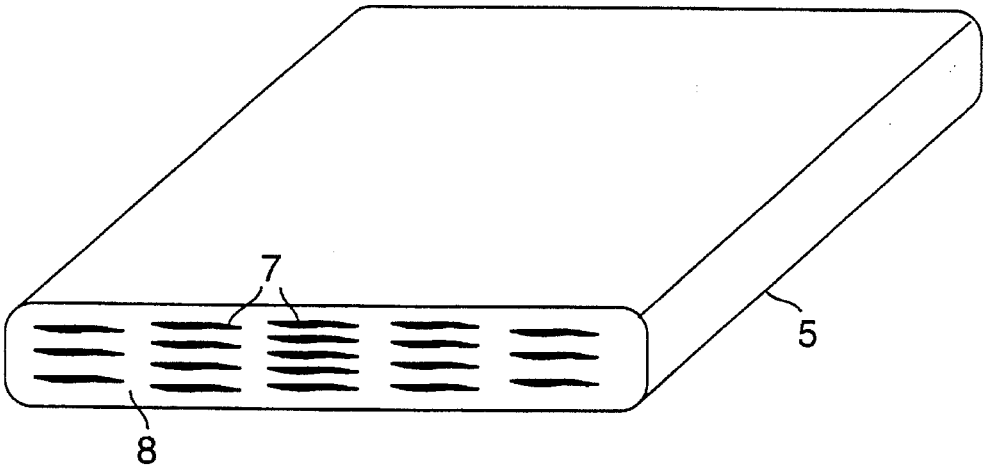
FIG. 1
PRIOR ART
FIG. 5
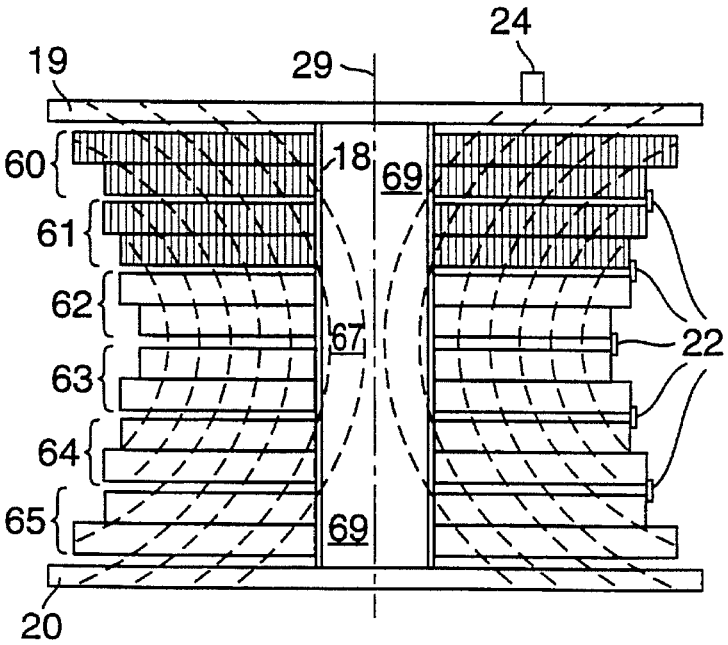

SHAPED SUPERCONDUCTING MAGNETIC COIL

BACKGROUND OF THE INVENTION

The invention relates to superconducting magnetic coils.

As is known in the art, the most spectacular property of a superconductor is the disappearance of its electrical resistance when it is cooled below a critical temperature $T_c$.

Below $T_c$ and a critical magnetic field, a superconductor can carry a electrical current density up to a critical current density ($J_c$) of the superconductor. The critical current density is the current density at which the material loses its superconducting properties and reverts back to its normally conducting state.

Superconductors may be used to fabricate superconducting magnetic coils such as solenoids, racetrack magnets, multipole magnets, etc., in which the superconductor is wound into the shape of a coil. When the temperature of the coil is sufficiently low that the HTS conductor can exist in a superconducting state, the current carrying capacity as well as the magnitude of the magnetic field generated by the coil is significantly increased.

Typical superconducting materials include niobium-titanium, niobium-tin, and also copper oxide ceramics such as members of the rare-earth-copper-oxide family (i.e., YBCO), the thallium-barium-calcium-copper-oxide family (i.e., TBCCO), the mercury-barium-calcium-copper-oxide family (i.e., HgBCCO), and BSCCO compounds containing lead (i.e.,$(Bi,Pb)_2Sr_2Ca_2Cu_3O_{10}$). $Bi_2Sr_2Ca_2Cu_3O_{10}$(BSCCO (2223)), performs particularly well because its superconductivity and corresponding high current density characteristics are achieved at relatively high temperatures ($T_c$=115 K).

Referring to FIG. 1, in fabricating such superconducting magnetic coils, the superconductor may be formed in the shape of a thin tape 5 which allows the conductor to be bent around the diameter of a core. The thin tape is fabricated as a multi-filament composite superconductor including individual superconducting filaments 7 which extend substantially the length of the multi-filament composite conductor and are surrounded by a matrix-forming material 8, which is typically silver or another noble metal. Although the matrix forming material conducts electricity, it is not superconducting. Together, the superconducting filaments and the matrix-forming material form the multi-filament composite conductor. In some applications, the superconducting filaments and the matrix-forming material are encased in an insulating layer (not shown). The ratio of superconducting material to matrix-forming material is known as the "fill factor" and is generally less than 50%.

A magnetic coil can be wound with superconducting tape using generally one of two approaches. In the first approach, known as layer winding, the superconductor is wound about a core with turns being wound one next to another until a first layer is formed. Subsequent layers are then wound on top of previous layers until the desired number of layers are wound on the core.

In an other approach, known as pancake winding, the superconductor tape is wound one turn on top of a preceding turn thereby forming a plane of turns perpendicular to the axis of the coil. In applications where a series of pancake coils are to be used to form a coil, the pancake coils can be wound as double pancakes.

In some applications, a superconducting magnetic coil assembly using pancake coils (whether single or double) may include several coils, coaxially disposed along the length of the coil assembly. The individual coils are interconnected using short lengths of superconducting wire or ribbon made from the superconducting materials of the type described above, for example, copper oxide ceramic.

SUMMARY OF THE INVENTION

In one aspect of the invention, double pancake coils, wound to have a pair of individual pancake coils of differing outer dimensions, are coaxially disposed and electrically connected along a longitudinal axis to provide a multi-coil superconducting magnetic coil assembly with at least one interior double pancake coil having an individual pancake coil electrically connected to an individual pancake coil of an adjacent double pancake coil at an interface between pancake coils (at the point of their electrical connection) of substantially equivalent outer dimension. The electrical interconnections are accomplished using relatively straight or "unbent" segments of superconducting wire between the individual pancakes, of adjacent double pancake pairs, of substantially equal outer dimension. Although the segments of superconducting wire may have a slight bend for following the outer contour of the pancake coil in the direction perpendicular to its longitudinal axis, the segments are unbent along the longitudinal axis of the coil as they span the individual coils of adjacent double pancakes. Thus, the superconducting magnetic coil assembly can have a non-uniform outer dimension along its length for providing field shaping or field concentration while allowing the use of straight, unbent pieces of superconductor which provide a low loss electrical interconnection between the double pancake coils of the assembly.

Providing the electrical interconnection with an unbent piece of superconducting wire .increases both the electrical and mechanical reliability of the interconnections. This is, for the most part, due to the mechanical properties of the materials chosen to provide the desired superconducting characteristics. Such materials, like those of the copper oxide ceramic type, are generally intolerant of the application of large tensional forces (such as those created during a bending process) and may easily crack or break when excessively bent. Such materials are often characterized by their bend strain and critical strain values. The bend strain is equal to half the thickness of the conductor divided by the radius of the bend, while the critical strain of a conductor is defined as the amount of strain the material can support before experiencing a dramatic decrease in electrical performance. The critical strain value is highly dependent on the formation process used to fabricate the conductor, and is typically between 0.05%–1.0%, depending on the process used. With an increase in bend strain comes a concomitant increase in resistance and increase in voltage across the joint. If the bend strain of a conductor exceeds the critical strain of a conductor, the resistance increases to the extent that the current-carrying capability of the conductor, and hence the maximum magnetic field generated by a coil, decreases significantly.

Particular embodiments of the invention may include one or more of the following features.

In some applications, the outer dimension of adjacent double pancake coils may increase along the longitudinal axis of the superconducting magnetic coil from a central region to end regions of the superconducting magnetic coil. A superconducting magnetic coil having such an arrangement provides a substantially uniform magnetic field along its axial length useful, for example, in magnetic resonance imaging (MRI) applications.

In another application, the outer dimension of adjacent double pancake coils may decrease along the longitudinal axis of the superconducting magnetic coil from the central region to end regions, thereby providing a greater amount of superconductor at the central region where the magnetic field is desired to be maximized while reducing the amount of superconductor at its end regions. As a result, the overall amount of superconductor generally needed to provide the level of magnetic field at the central region is reduced.

The double pancake coils may be circularly shaped with the electrical connections between individual pancake coils of adjacent double pancake coils of substantially equivalent outer diameters. Alternatively, the double pancake coils may be racetrack or saddle-shaped (i.e., outermost radial regions which droop). The superconductor may be anisotropic, for example, an anisotropic high temperature superconductor, such as $Bi_2Sr_2Ca_2Cu_3O$. The superconductor may be formed as a superconductor tape comprising a multi-filament composite superconductor including individual superconducting filaments which extend the length of the multi-filament composite conductor and are surrounded by a matrix-forming material. The multi-filament composite superconductor may, in certain applications, be twisted. Electrically conductive bridging segments formed, for example, as a superconductor tape comprising a composite superconductor material, may be used to provide the electrical connections between individual pancake coils of adjacent double pancake coils.

In another aspect of the invention, a method for providing a superconducting magnetic coil assembly features the following steps:

a) providing double pancake coils, each comprising a pair of pancake coils wound from a continuous length of superconductor about a longitudinal axis of the coil assembly, the coil assembly having a varying outer dimension along its longitudinal axis;

b) positioning the double pancake coils so that at least one pancake coil of each double pancake coil has an outer dimension substantially equal to an outer dimension of an adjacent pancake coil of an adjacent double pancake; and c) electrically connecting the at least one pancake coil of each double pancake to the pancake coil of the adjacent double pancake of substantially equal outer dimension.

In preferred embodiments, the double pancake coils may be connected with an unbent length of superconducting material.

In another aspect of the invention, a superconducting magnetic double pancake coil includes a first pancake coil having a first outer dimension comprising a superconductor wound about a longitudinal axis of the coil and a second pancake coil, having a second outer dimension different than said first dimension, comprising a superconductor wound about the longitudinal axis of the coil, with the first and second pancake coils being wound from the same continuous length of superconducting material.

In another aspect of the invention, a superconducting magnetic coil assembly includes at least a plurality of coaxially disposed double pancake coils, each including a pair of individual pancake coils, with at least one interior individual pancake coil of one of the double pancake coils having different physical dimensions in the radial direction than an adjacent individual pancake coil, and being connected to that adjacent individual pancake coil of different physical dimension with a substantially unbent segment of electrically conductive material at a point where corresponding dimensions of adjacent pancake coils are substantially equal.

Other advantages and features will become apparent from the following description and the claims.

BRIEF DESCRIPTION OF THE DRAWINGS

FIG. 1 is a cross-sectional view of a multi-filament composite conductor.

FIG. 5 is a cross-sectional view of an alternate embodiment of the invention.

DESCRIPTION OF THE PREFERRED EMBODIMENTS

Figure 2:
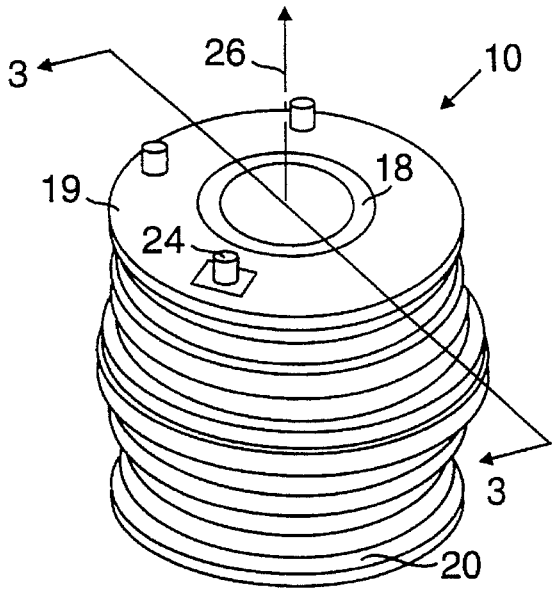
FIG. 2 is a perspective view of a multiply stacked superconducting coil having double pancake coils.
Figure 3:
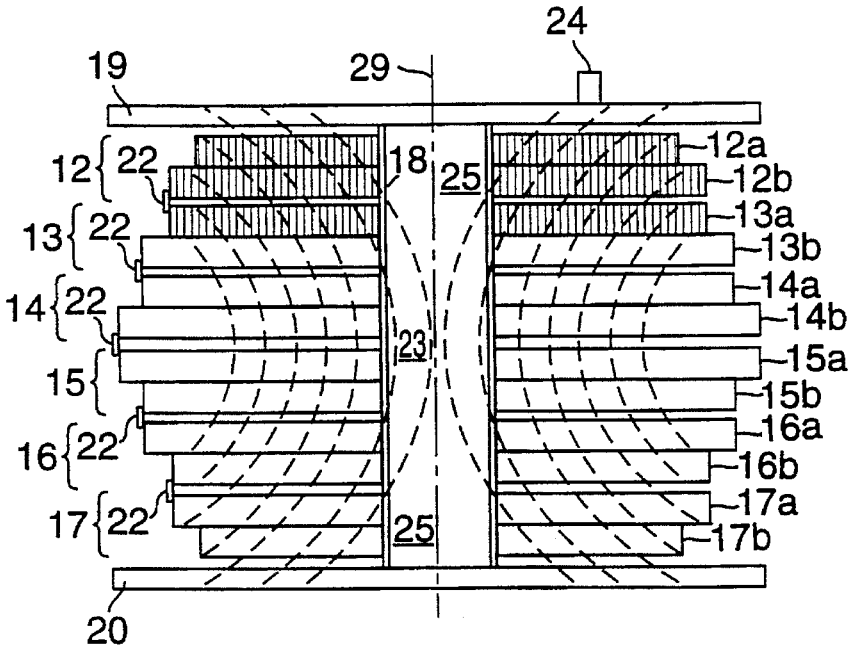
FIG. 3 is a cross-sectional view of FIG. 2 taken along line 3—3.

Referring to FIGS. 2–3, a mechanically robust, high-performance superconducting coil assembly 10 combines multiple double "pancake" coils 12–17, here, six separate double pancake sections, each having co-wound composite conductors. Each double "pancake" coil has co-wound conductors wound in parallel which are then stacked coaxially on top of each other. The illustrated conductor is a high temperature copper oxide ceramic superconducting material, such as $Bi_2Sr_2Ca_2Cu_3O$, commonly designated BSCCO (2223). Each double pancake coil 12–17 includes a pancake coil **12*a*–17*a* having a diameter smaller than its associated pancake coil 12*b*–17*b* of the double pancake, the two coils of a pair being wound from the same continuous length of superconducting tape using the approach described below in conjunction with FIG. 4. Double pancake coils 12–17 are shown in FIGS. 2 and 3** as being circularly shaped; however, in other applications each double pancake may have other shapes commonly used for making magnetic coils, including racetrack and saddle-shaped coils.

An inner support tube 18 supports coils 12–17 with a first end member 19 attached to the top of inner support tube 18 and a second end member 20 threaded onto the opposite end of the inner support tube in order to compress the double "pancake" coils. Inner support tube 18 and end members 19, 20 are fabricated from a non-magnetic material, such as aluminum or plastic (for example, G-10). In some applications, inner support tube 18 and end members 19, 20 can be removed to form a free-standing coil assembly. The current is assumed to flow in a counter-clockwise direction as shown in FIG. 3, with the magnetic field vector 26 (FIG. 2) being generally normal to end member 19 (in the direction of longitudinal axis 29) which forms the top of coil assembly 10.

Short bridging segments 22 of superconducting material are used to electrically connect the individual double pancake coils 12–17 together in a series circuit and are formed of the same $Bi_2Sr_2Ca_2Cu_3O$ material used for winding the coils themselves. Furthermore, segments 22 interconnect adjacent double pancakes along interfaces where the outer diameters of the individual pancakes are substantially the same. For example, a segment 22 is shown bridging pancakes **12*b* and 13*a* of double pancakes 12 and 13, respectively. Short bridging segments 22 are only required along the outer diameter of the coil assembly because the interfaces between pancakes of different diameters lie along the inner diameter of the coil assembly 10 where no "joint" exists by virtue of the double pancake winding technique described immediately below in conjunction with FIG. 4. By providing adjacent pancake coils of substantially the same outer diameter, the superconductor bridging segments need not be bent or otherwise tensioned, thereby avoiding the undesirable effects noted above. A length of superconducting material (not shown) also connects one end of coil assembly 10 to one of the termination posts 24 located on end member 18 in order to supply current to coil assembly 10**. The bridging segments may be fabricated from metal, composite superconductor, or a pure superconductor.

The distribution of superconductor along the axial length of coil assembly 10 is not uniform but includes a greater amount of superconductor at central regions of the assembly than at end regions. This configuration of double pancakes 12–17 is well suited for applications in which an increase in the magnetic field at a center region 23 of coil assembly 10 is desired and the level of magnetic field at outer end regions 25 of the coil is of less importance. Although the level of magnetic field could be accomplished using a superconducting magnetic coil having a uniform outer diameter equal to that of the largest diameter pancake of coil assembly 10, for example, pancakes 14*b* and 15*a*, this magnetic field would have been achieved using a greater amount of superconductor, which is then required to be cooled, and therefore is less energy efficient.

In one embodiment of the invention, seven double pancake coils were coaxially aligned along a longitudinal axis providing a superconducting magnetic coil assembly having a height of 2.75 inches. The seven double pancake coils were wound with BSCCO (2223)/silver superconducting composite tape and all have an inner diameter of 1.125 inches defining the inner bore of the coil assembly. Three of the seven double pancake coils were of the conventional type (i.e., individual pancakes of the same outer diameter) and have an outer diameter of about 6.0 inches. Two of the other seven double pancake coils were also of the conventional type and have an outer diameter (O.D.) of about 5.0 inches. These two double pancake coils were positioned at each end of the coil assembly. Between the endmost smaller 5.0 inch outer diameter double pancake coils and the centermost 6.0 inch outer diameter double pancake coils were two double pancake coils, fabricated in accordance with the invention. Each of these two double pancake coils act as transition coils, and include an individual pancake having an outer diameter of 5.0 inches and an individual pancake having an outer diameter 6.0 inches. Electrical interconnections between the double pancake coils were provided with short lengths of the same composite superconducting tape used to wind the double pancake coils. This superconducting magnetic coil assembly provided a center axial magnetic field of 2.1 Tesla when cooled by a mechanical cryocooler at 27° K.

Figure 4:
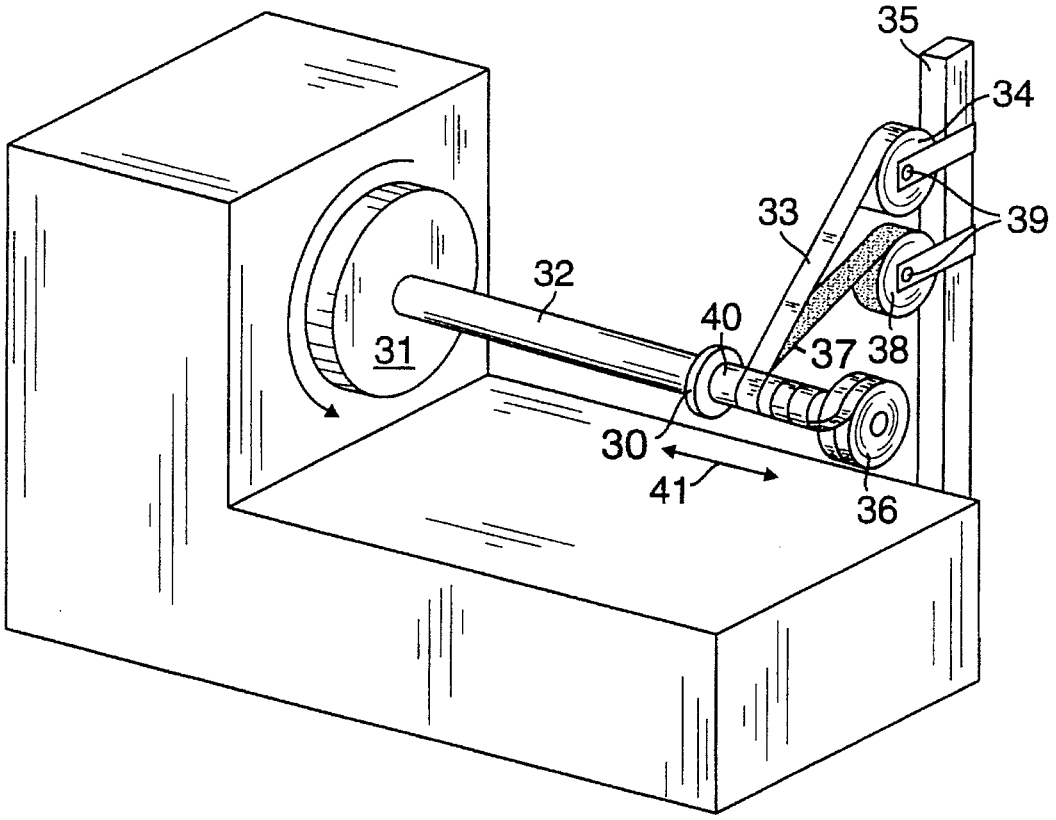
FIG. 4 illustrates a coil winding device.

Referring to FIG. 4, an approach for forming each one of double "pancake" coils 12–17 is described. This approach is described more fully in co-pending application Serial No. 08/188,220 filed on Jan. 28, 1994, by M. D. Manlief, G. N. Riley, Jr., J. Voccio, and A. J. Rodenbush, entitled "Superconducting Composite Wind-and-React Coils and Methods of Manufacture", assigned to the assignee of the present invention and hereby incorporated by reference. In this approach, a mandrel 30 is first mounted on a winding shaft 32 which is mounted in lathe chuck 31. A storage spool 36 is mounted on the winding shaft 32, and a first portion of the total length of tape 33, initially wrapped around spool 34 and needed for winding one of the pancakes (generally the larger diameter pancake), is wound onto the storage spool 36, resulting in the length of tape 33 being shared between the two spools. The spool 34 mounted to the arm 35 contains the first portion of the length of tape 33, and the storage spool 36 containing the second portion of the tape 33 is secured so that it does not rotate relative to mandrel 30. The cloth 37 wound on the insulation spool 38 is then mounted on the arm 35. The mandrel is then rotated, and the cloth 37 is co-wound onto the mandrel 30 with the first portion of the tape 33 to form a single "pancake" coil. Thermocouple wire is wrapped around the first "pancake" coil in order to secure it to the mandrel. The winding shaft 32 is then removed from the lathe chuck 31, and the storage spool 36 containing the second portion of the length of tape 33 is mounted on arm 35. A layer of insulating material is then placed against the first "pancake" coil, and the second half of the tape 33 and the cloth 37 are then co-wound on the mandrel 30 using the process described above. This results in the formation of a second "pancake" coil adjacent to the "pancake" coil formed initially, with a layer of insulating material separating the two coils. Thermocouple wire is then wrapped around the second "pancake" coil to support the coil structure during the final heat treatment. Voltage taps and thermocouple wire can be attached at various points on the tape 33 of the double "pancake" coil in order to monitor the temperature and electrical behavior of the coil. In addition, all coils can be impregnated with epoxy after heat treating in order to improve insulation properties and hold the various layers firmly in place. The double "pancake" coil allows one edge of the entire length of tape to be exposed directly to the oxidizing environment during the final heat treating step.

The arrangement of double pancake coils described above and shown in FIGS. 2 and 3 provides a relatively energy efficient superconducting coil assembly where the magnetic field is high at the center of the coil. The concept of the invention can also be used to provide a superconducting magnetic coil, wound with an anisotropic superconductor material, where the objective is to achieve uniformity of the current carrying capacity of the coil across its axial length. For example, referring to FIG. 5, the outer diameters of double pancakes 60–65 become increasingly larger from a center region 67 of the coil to the end regions 69 in order to compensate for the decrease in current carrying capacity which is related to the magnitude of the perpendicular component of the magnetic field. As is well known in the art (when using anisotropic superconducting materials, such as the Cu-O-based ceramic superconductor described above) the perpendicular component of the magnetic field is at a minimum in the central region of the coil where the lines are generally parallel with the longitudinal axis of the coil and become increasingly perpendicular at end regions where the flux lines bend around to close the loop.

Other embodiments are within the claims. For example, any arrangement of pairs of pancake coils where the outer diameter of adjacent pancakes are substantially the same can be used to provide the desired magnetic field characteristic of the coil assembly. For example, coil assemblies having double pancakes wound to have pancakes of different diameters can be used equally as well with individual pancakes or with double pancake coils of uniform outer diameter. The coil assemblies may have a longitudinal, outer diameter profile which, from a central region of the coil, increases or decreases along the longitudinal axis toward the end regions of the coil. Alternatively, outer diameter profile may be stepped up and down along the axis of the coil to provide any desired field shaping profile. The concept of the invention is also applicable to superconducting magnetic coils of various shapes including racetrack magnets, solenoids and multipole magnets.

What is claimed is:

1. A superconducting magnetic coil assembly comprising:

at least a plurality of coaxially disposed double pancake coils, at least one interior double pancake coil including a pair of individual pancake coils having differing outer dimensions, each individual pancake coil comprising a superconductor wound about a longitudinal axis of the coil assembly; and the individual pancake coils of each double pancake coil electrically connected to an individual pancake coil of an adjacent double pancake coil along an outer dimension of the adjacent double pancake coil, the electrically connected pancake coils having outer dimensions at the point of their electrical connection substantially equal.

2. The superconducting magnetic coil of claim 1 wherein the outer dimension of adjacent double pancake coils increases along the longitudinal axis of the superconducting magnetic coil from a central region to end regions of the superconducting magnetic coil.

3. The superconducting magnetic coil of claim 1 wherein the outer dimension of adjacent double pancake coils decreases along the longitudinal axis of the superconducting magnetic coil from a central region to end regions of the superconducting magnetic coil.

4. The superconducting magnetic coil of claim 1 wherein the double pancake coils have a circular shape and the electrically connected pancake coils have outer diameters that are substantially equal.

5. The superconducting magnetic coil of claim 1 wherein the double pancake coils are racetrack shaped.

6. The superconducting magnetic coil of claim 1 wherein the double pancake coils are saddle-shaped.

7. The magnetic coil of claim 1 wherein the superconductor is an anisotropic high temperature superconductor.

8. The magnetic coil of claim 7 wherein the anisotropic high temperature superconductor is $Bi_2Sr_2Ca_2Cu_3O$.

9. The magnetic coil of claim 1 wherein the superconductor is formed as a superconductor tape comprising a multi-filament composite superconductor including individual superconducting filaments which extend the length of the multi-filament composite conductor and are surrounded by a matrix-forming material.

10. The magnetic coil of claim 1 wherein electrically conductive bridging segments provide the electrical connections between individual pancake coils of adjacent double pancake coils.

11. The magnetic coil of claim 10 wherein the electrically conductive bridging segments are formed as a superconductor tape comprising a composite superconductor material.

12. A method for providing a superconducting magnetic coil assembly having a varying outer dimension along a longitudinal axis of the coil assembly comprising the steps of:

a) providing double pancake coils, each comprising a pair of pancake coils wound from a continuous length of superconductor about the longitudinal axis of the coil assembly and at least one of said double pancake coils including a pair of pancake coils having differing outer dimensions;

b) positioning the double pancake coils so that at least one pancake coil of each double pancake coil has an outer dimension substantially equal to an outer dimension of an adjacent pancake coil of an adjacent double pancake; and c) electrically connecting the at least one pancake coil of each double pancake to the pancake coil of the adjacent double pancake of substantially equal outer dimension.

13. The method of claim 12 further comprising the step of connecting said double pancake coils with an unbent length of superconducting material.

14. A superconducting magnetic double pancake coil comprising:

a first pancake coil having a first outer dimension comprising a superconductor wound about a longitudinal axis of the coil;

a second pancake coil, having a second outer dimension different than said first dimension, comprising a superconductor wound about the longitudinal axis of the coil; and wherein said first and second pancake coils are wound from a continuous length of superconducting material.

15. A superconducting magnetic coil assembly comprising at least a plurality of coaxially disposed double pancake coils, each including a pair of individual pancake coils, at least one interior individual pancake coil of one of the double pancake coils having different physical dimensions in the radial direction than an adjacent individual pancake coil, and being connected to that adjacent individual pancake coil of different physical dimension with a substantially unbent segment of electrically conductive material at a point where corresponding dimensions of adjacent pancake coils are substantially equal.

* * * * *